US005517283A

United States Patent [19]

Hori et al.

[11] Patent Number: 5,517,283

[45] Date of Patent: May 14, 1996

[54] IMAGE FORMING APPARATUS INCLUDING IMPROVED TONER IMAGE DENSITY DETECTING ARRANGEMENT

[75] Inventors: Kazuto Hori; Sadao Tanigawa, both of Osaka, Japan

[73] Assignee: Mita Industrial Co., Ltd., Japan

[21] Appl. No.: 63,567

[22] Filed: May 19, 1993

[30] Foreign Application Priority Data

May 22, 1992 [JP] Japan ..... 4-130286

[51] Int. Cl.[6] ..... G03G 21/00

[52] U.S. Cl. ..... 355/208; 355/214; 355/246

[58] Field of Search ..... 355/208, 245, 355/246, 214; 118/688–691

[56] References Cited

U.S. PATENT DOCUMENTS

| | | | |
|---|---|---|---|
| 5,134,438 | 7/1992 | Nakashima | 355/208 |
| 5,151,740 | 9/1992 | Fujimoto | 355/246 |
| 5,216,469 | 6/1993 | Yamada | 118/691 X |
| 5,227,842 | 7/1993 | Hayashi et al. | 355/208 |
| 5,245,390 | 9/1993 | Ishigaki et al. | 355/246 |

FOREIGN PATENT DOCUMENTS

| | | |
|---|---|---|
| 61-173260 | 8/1986 | Japan . |
| 3-116062 | 5/1991 | Japan . |
| 3-130786 | 6/1991 | Japan . |
| 3-184067 | 8/1991 | Japan . |

*Primary Examiner*—Arthur T. Grimley
*Assistant Examiner*—Shuk Y. Lee
*Attorney, Agent, or Firm*—Beveridge, DeGrandi, Weilacher & Young

[57] ABSTRACT

An image forming apparatus capable of detecting a toner image density well by shifting a developing bias. In adjusting a fog density or a solid density, the developing bias is shifted by a specified width so as to form an image of a gray density. This enables detection of the fog density and the solid density to be replaced with detection of a density in a gray density region where a reflection type photosensor can detect a density with high sensitivity. Thus, densities in a fog or solid density region where usually an output from the reflection type photosensor is saturated can be detected with high accuracy.

11 Claims, 13 Drawing Sheets

IMAGE FORMING APPARATUS INCLUDING IMPROVED TONER IMAGE DENSITY DETECTING ARRANGEMENT

BACKGROUND OF THE INVENTION

1. Field of the Invention

The present invention relates to an image forming apparatus, such as an electrostatic copying machine, a laser beam printer, etc., which forms an image according to an electrophotographic process.

2. Description of the Related Art

In an electrostatic copying machine, a copy image is formed as in the following manner. First, a surface of an original is illuminated and scanned, and a photoconductor drum is rotated synchronous with the illumination and scanning. At this point, the photoconductor drum is exposed to reflected light from the original. A surface of the photoconductor drum before exposure is electrostatically charged uniformly, and it is selectively discharged by exposure to form an electrostatic latent image corresponding to an original image.

The electrostatic latent image thus formed is developed into a toner image by a developing device, and the toner image is transferred to a copy sheet through corona discharge caused by a corona discharger for transfer. The copy sheet carrying the transferred toner image is led to a fuser to fix toner to the sheet, and thus, a copy is obtained.

A density of an image formed on a sheet varies depending upon a degree of the exposure of the photoconductor drum, a degree of the electrostatic charge on the photoconductor drum, a developing bias, etc. Utilizing such a phenomenon, the density of the image formed on the sheet can be adjusted. In an arrangement for adjusting the developing bias to regulate the density, for example, the developing bias is varied in accordance with a density set by an operator or a density of an original automatically sensed.

In order to use several separate copying machines to obtain uniform images corresponding to a density which is set by an operator, for example, it is necessary adjust parameters in connection with a photoconductor drum in advance for each copying machine, where "parameters" are image forming conditions such as a degree of exposure of the photoconductor drum, a degree of electrostatic charge, a developing bias, etc. Thus, at the last stage of producing copying machines or upon a maintenance check of the copying machines, various parameters related to each photoconductor drum must be adjusted to make a uniform density for a copy image formed by each copying machine.

In typical prior art technology for adjustments in the above-mentioned situation, a photosensor is placed relative to the photoconductor drum so as to sense a density of a toner image formed on a surface of the photoconductor drum. When each parameter in connection with the photoconductor drum is to be adjusted, a reference original which contains an image of a reference density is copied on trial. An engineer conducting adjustments decides if the density of the toner image sensed by the photosensor conforms to the reference density. Judging from a result, the engineer regulates each parameter in connection with the photoconductive drum.

Even if a copy image of a desirable density is once obtained based upon a reference original of a certain density, a copy image of an adequate density is not always obtained based upon a reference original of another density. Then, reference originals at several density levels from a fog density corresponding to a density of the background of an image (i.e., white) to a solid density corresponding to a solid image (i.e., black) are copied on trial, and parameters in connection with the photoconductor drum are adjusted so that an image at any density level from the fog density to the solid density can be reproduced well. After such adjustments, an image of any density in an original can be copied into a well-reproduced image.

For the photosensor for detecting a density of a toner image, a reflection type photosensor is generally applied. The reflection type photosensor includes a light emitting element and a light receiving element put in position opposed to the photoconductor drum. The light emitting element emits a fixed quantity of light and the light receiving element receives reflected light from the photoconductor drum to sense the quantity of the reflected light. Output from the light receiving element corresponds to a density of a toner image on a surface of the photoconductor drum.

FIG. 13 is a diagram illustrating an output characteristic of the above-mentioned reflection type photosensor. In FIG. 13, there are shown outputs from the reflection type photosensor when the reference originals at various density levels are copied respectively under fixed conditions of a degree of exposure of the photoconductor drum, a degree of electrostatic charge, the developing bias, etc. For a reference original, a Munsell original is used. A density value rising as the density increases is applied to a Munsell original. For example, density value "0" corresponds to a white original while density value "10" corresponds to a solid black original.

As can be seen in FIG. 13, the outputs from the reflection type photosensor vary in a relatively linear manner in a region of gray or medium densities. Hence, the reflection type photosensor can sense differences in density; that is, it can be determined well if there is any difference between the density of actual toner images and the reference density based upon the outputs from the reflection type photosensor.

However, regarding the fog density and the solid density, it is likely to misjudge an adequate density of the toner image. The fog density corresponds to the density value "0" while the solid density corresponds to the density value "10". In such extreme density regions, the outputs from the reflection type photosensor are saturated, as shown by alphanumeric symbols A1 and A2 in FIG. 13. Regarding the fog density and the solid density, there is less variation in the outputs from the reflection type photosensor. Hence, it cannot be determined with good accuracy if there is any difference between the density of the toner image and the reference density. This may cause maladjustment of the density.

To overcome an above-mentioned disadvantage, it may be proposed that a reflection type photosensor having an output characteristic linear in any density region; however, it is difficult to realize such an output characteristic because of features of the sensor.

Then, there may be an improvement that a variable resistance is connected to the light emitting element and the light receiving element constituting the reflection type photosensor to alter the output characteristic of the reflection type photosensor; that is, an operative point and a sensitivity of the sensor are altered by varying a resistance value of the variable resistance.

An output characteristic of the reflection type photosensor after adjustment of the variable resistance is shown in FIG. 14. The fog density can be detected well under the output characteristic expressed by a curve L1 while the solid density can be detected well under the output characteristic expressed by a curve L2.

In such an arrangement, however, the reflecting type photosensor is connected with the variable resistance particularly provided for detection of the fog density and the solid density, so that there arises the disadvantage that the arrangement is complicated and therefore is costly in manufacturing.

SUMMARY OF THE INVENTION

Accordingly, it is an object of the present invention to provide an image forming apparatus simple in structure and having an arrangement by which a density of a toner image can be detected well.

It is another object of the present invention to provide an image forming apparatus by which a density of an image can be adjusted well.

It is still another object of the present invention to provide a toner image density detecting method according to which a reflection type photosensor is used to detect a density of a toner image well.

It is yet another object of the present invention to provide a method of calibrating an output of a reflection type photosensor provided in an image forming apparatus for detecting a toner image density.

An image forming apparatus of the present invention for attaining these objects includes a photoconductor where an electrostatic latent image corresponding to an intended image is formed, a developing device for developing the electrostatic latent image to a toner image, and a reflection type photosensor for detecting a density of the toner image. When the density of the toner image is detected by the reflection type photosensor, a developing bias which is expressed by a potential difference between a surface of the photoconductor and the developing device is varied by a specified width.

Thus, even if the intended image is an image belonging to a density region where an output from the reflection type photosensor is saturated, a density of the toner image actually formed can have a value within a density region where the reflection type photosensor is operable with high sensitivity. At this time, the density of the toner image actually detected is of a value different from that of the density of the intended image. However, since the developing bias is varied by the specified width, the density of the toner image can be easily presumed with the developing bias of a value before varied. Specifically, as to the density of an image belonging to the density region where an output from the reflection type photosensor is saturated, the density of the toner image is shifted to a density region where a detection sensitivity of the reflection type photosensor is high to indirectly detect the density.

When the fog density is to be detected, for example, the developing bias is increased by a first specified width. This permits a toner image of a medium level density to be formed. The reflection type photosensor can detect such a medium level density with a good sensitivity. Based upon the output from the reflection type photosensor and the first specified width, the fog density can be presumed.

When the solid density is to be detected, the developing bias is decreased by a second specified width. This results in the density of the toner image being of a medium level value. The toner image of the medium level density is detected well by the reflection type photosensor. Then, based upon the output from the reflection type photosensor and the second specified width, the solid density can be presumed.

In this way, by shifting the developing bias by a specified width, detection of a density can be conducted well for all the density values which the toner image may exhibit. Thus, the image density can be adjusted well.

For an arrangement for varying the developing bias, an existing arrangement conventionally provided in an apparatus for forming an image by an electrophotographic process is used. Hence, no special arrangement for adjusting a density of an image is needed; that is, a component like a variable resistance connected to the reflection type photosensor is not needed, unlike the prior art. This leads to a simple structure of the apparatus.

These and other objects, features, and effects of the present invention will become more fully apparent from the following detailed description of the preferred embodiments when the present invention is considered in conjunction with the accompanying drawings.

DESCRIPTION OF THE PREFERRED EMBODIMENTS

Figure 1:
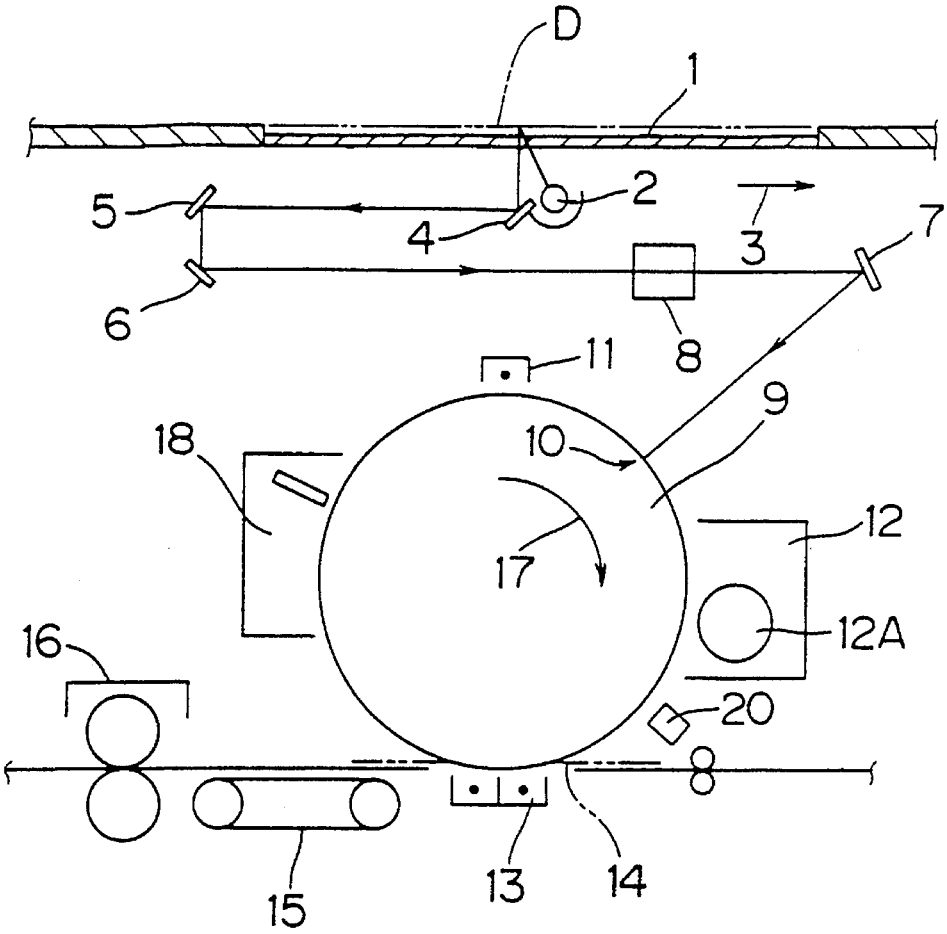
FIG. 1 is a schematic diagram depicting an internal structure of an electrostatic copying machine which is a first embodiment of an image forming apparatus according to the present invention.

FIG. 1 is a schematic diagram depicting an electrostatic copying machine which is a first preferred embodiment of an image forming apparatus according to the present invention. Under an original plate 1 made of transparent glass or the like, there is provided a light source 2 which illuminates and scans a surface of an original D put on the original plate 1. The light source 2 illuminates the surface of the original D, being carried toward a direction along an arrow 3 at a constant speed when a copying operation is performed.

Reflected light from the original D is reflected by reflecting mirrors 4, 5 and 6, led to and through a zoom lens 8, reflected by a reflecting mirror 7, and eventually led to an exposure region 10 on a surface of a photoconductor drum 9. This causes an inverted image of the original D to be made on the surface of the photoconductor drum 9. In the copying, the reflecting mirror 4 is carried with the light source 2 while the reflecting mirrors 5 and 6 are carried in the direction along the arrow 3 at a speed half as fast as the speed at which the light source 2 moves. In synchronization with movement of the light source 2, the photoconductor drum 9 is rotated in a direction of an arrow 17.

Before reaching the exposure region 10, the surface of the photoconductor drum 9 is electrostatically charged uniformly by a charger 11. The charger 11 causes corona discharge so that the photoconductor drum 9 can be electrostatically charged. Thus, after the surface of the photoconductor drum 9 is exposed in the exposure region 10 to reflected light from the original D and selectively discharged, an electrostatic latent image corresponding to an image inverted from the original D is formed.

The electrostatic latent image is developed into a toner image by a developing device 12. Then, the toner image developed is transferred by a transferor 13 into a surface of a recording copy sheet 14 (which may be made not only of paper but of transparent sheet used for an over head projector). The transferor 13 causes corona discharge to transfer the toner image. The sheet 14 having the toner image transferred thereon is carried by a carrier belt 15 to a fuser 16. In the fuser 16, by heating and pressurizing toner, the toner is fixed to the surface of the sheet 14, and thus, the copying is completed. The remaining toner on the surface of the photoconductor drum 9 after the toner image is transferred is eliminated by a cleaner 18.

Figure 2:
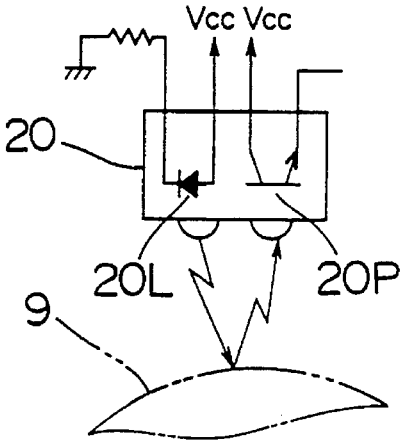
FIG. 2 is a circuit diagram showing a structure of a reflection type photosensor.

A reflection type photosensor 20 is placed in position close to the photoconductor drum 9 between the developer 12 and the transferor 13, opposed to a circumferential face of the photoconductor drum 9. As shown in FIG. 2, the reflection type photosensor 20 is comprised of a light emitting element 20L capable of emitting a fixed quantity of light and a light receiving element 20P receiving reflected light from the photoconductor drum 9. The quantity of the reflected light from the photoconductor drum 9 corresponds to a density of the toner image fixed to the surface of the photoconductor drum 9. Thus, an output signal from the light receiving element 20P corresponds to the density of the toner image on the surface of the photoconductor drum 9.

The density of the toner image is varied by varying parameters related to the photoconductor drum 9. "Parameters" herein means image forming conditions; for example, a developing bias which is expressed by a potential difference between the photoconductor drum 9 and a developing sleeve 12A of the developer 12, a degree of exposure of the photoconductor drum 9, and a degree of electrostatic charge of the photoconductor drum 9.

Figure 3:
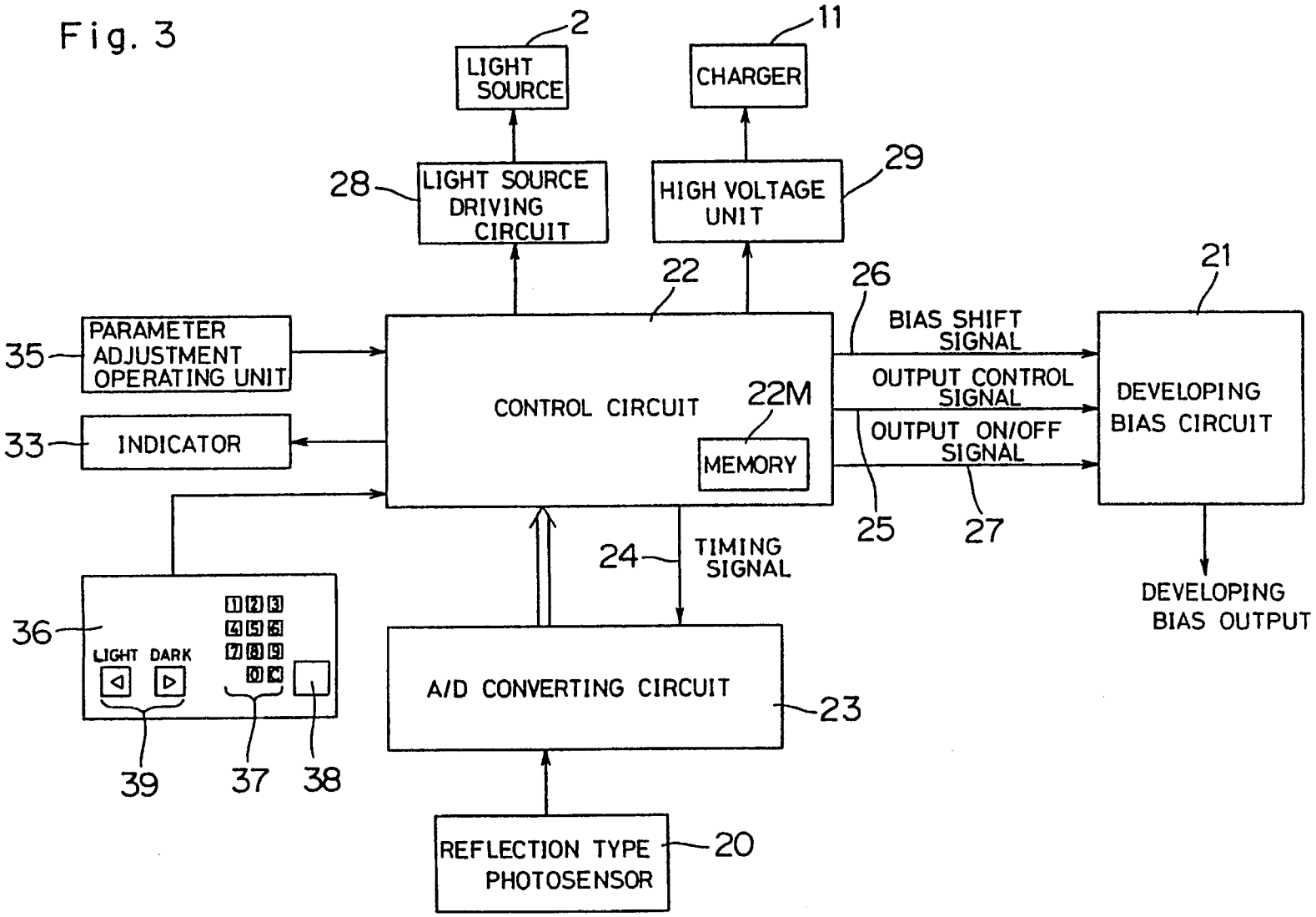
FIG. 3 is a block diagram showing an electrical architecture of components related to an image density control in the electrostatic copying machine in the above embodiment.

FIG. 3 is a block diagram showing an electrical architecture for controlling an image density. A developing bias circuit 21 for applying a developing bias between the photoconductor drum 9 and the developer 12 is connected to a control circuit 22 which functions to control the whole copying machine. The control circuit 22 includes a microcomputer (not shown) and a memory 22M. If a dark potential of the electrostatic charge of the photoconductor drum 9 is approximately 700 V, for example, a fixed potential of −200 V is applied to the developing sleeve 12A of the developer 12 while a potential ranging from −200 V to 500 V is applied to the photoconductor drum 9.

The control circuit 22 is connected to an analog-digital (A/D) converting circuit 23 for converting an output from the reflection type photosensor 20 to a digital data. The A/D converting circuit 23 receives a timing signal for sampling from a line 24.

The control circuit 22 applies an output control signal via a line 25 to the developing bias circuit 21. The developing bias circuit 21 applies a developing bias corresponding to the output control signal between the photoconductor drum 9 and the developing sleeve 12K; specifically, it varies a potential applied to the photoconductor drum 9.

The control circuit 22 also receives a bias shift signal for increasing or decreasing the potential at the photoconductor drum 9 by a specified width (e.g., 200 V) from a line 26. Moreover, it receives an output ON/OFF signal for starting or interrupting output of the developing bias from a line 27. The bias shift signal and the output ON/OFF signal are produced in adjustments of an image density, particularly in adjustments of a fog density and a solid density.

The developing bias circuit 21 and the control circuit 22 function as developing bias control means. The control circuit 22 also functions as bias shift means.

The control circuit 22 is connected to a parameter adjustment operating unit 35 for adjusting various parameters related to the photoconductor drum 9, a key input unit 36 provided on a top side of a copying machine body (not shown), and an indicator 33 for conducting display of various numeric values. The key input unit 36 includes ten keys 37 used for setting the number of required copies, a print key 38 for instructing to start copying, and a density setting key 39 for setting a copy density. Instead of the density setting key 39, a slide volume may be provided. The indicator 33 indicates the number of copies, a size of a sheet, etc., and it indicates a density of a toner image when the copy density is adjusted. The parameter adjustment operating unit 35 may be alternatively replaced with part of the keys in the key input unit 36, or otherwise be provided separate from the key input unit 36.

The control circuit 22 is connected to a light source driving circuit 28 for supplying power to the light source 2, and a high voltage unit 29 for applying high voltage to the charger 11. The control circuit 22 can control the light source driving circuit 28 to control the quantity of light emitted by the light source 2. Thus, the control circuit 22 can control a degree of exposure of the photoconductor drum 9, and moreover, it can control the high voltage unit 29 to control a degree of electrostatic charge of the photoconductor drum 9. In this way, the control circuit 22 controls an image density by controlling the developing bias, the degree of exposure, and the degree of electrostatic charge.

Figure 4:
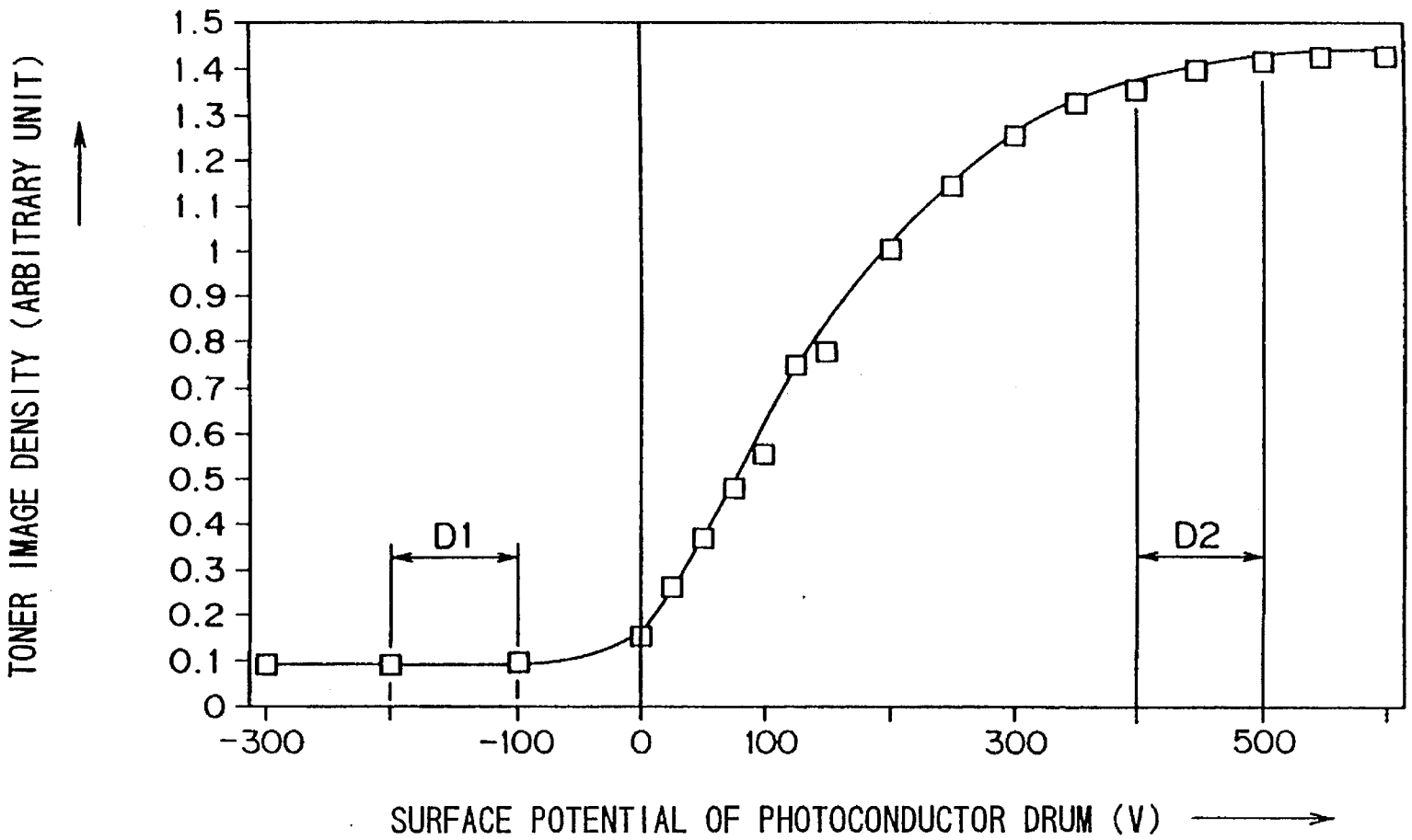
FIG. 4 is a diagram showing variations in a density of a toner image related to a surface potential at a photoconductor drum.

FIG. 4 is a diagram showing variations in a toner image density related to a surface potential of the photoconductor drum 9 where the degree of exposure and the degree of electrostatic charge are deemed uniform. As can be seen in FIG. 4, the toner image density is low with a low surface potential while it is high with a high surface potential. However, the toner image density exhibits almost no variation in sections D1 and D2 at opposite extremes of a variable range of the surface potential.

In an actual copying process, a surface potential corresponding to a fixed developing bias (e.g., 0 V) is applied to the photoconductor drum 9. Then, the surface potential varies from portion to portion in the photoconductor drum 9 in a range from −200 to 500 V depending upon an obtained electrostatic latent image. Thus, it will be recognized that FIG. 4 illustrates variations in the toner image density formed on the surface of the photoconductor drum 9 when several originals ranging from a low density to a high density are copied with a fixed developing bias, where the section D1 corresponds to a fog density while the section D2 corresponds to a solid density.

At a stage of producing copying machines or upon a maintenance check of the copying machines, the copy density is adjusted. In adjusting the copy density, reference originals having images at several density levels from the fog density to the solid density are copied on trial, and a density of a toner image formed on the surface of the photoconductor drum 9 is detected for each reference original. An engineer conducting adjustments manipulates the parameter adjustment operating unit 35 based upon detected values to adjust parameters such as a degree of exposure, a degree of electrostatic charge, a developing bias, etc. Furthermore, after searching for parameters according to which good copy densities can be obtained for any one of the reference originals at various levels from the fog density to the solid density, the parameters are stored in the memory 22M of the control circuit 22. For the reference originals, Munsell originals as stated above may be used.

Figure 5:
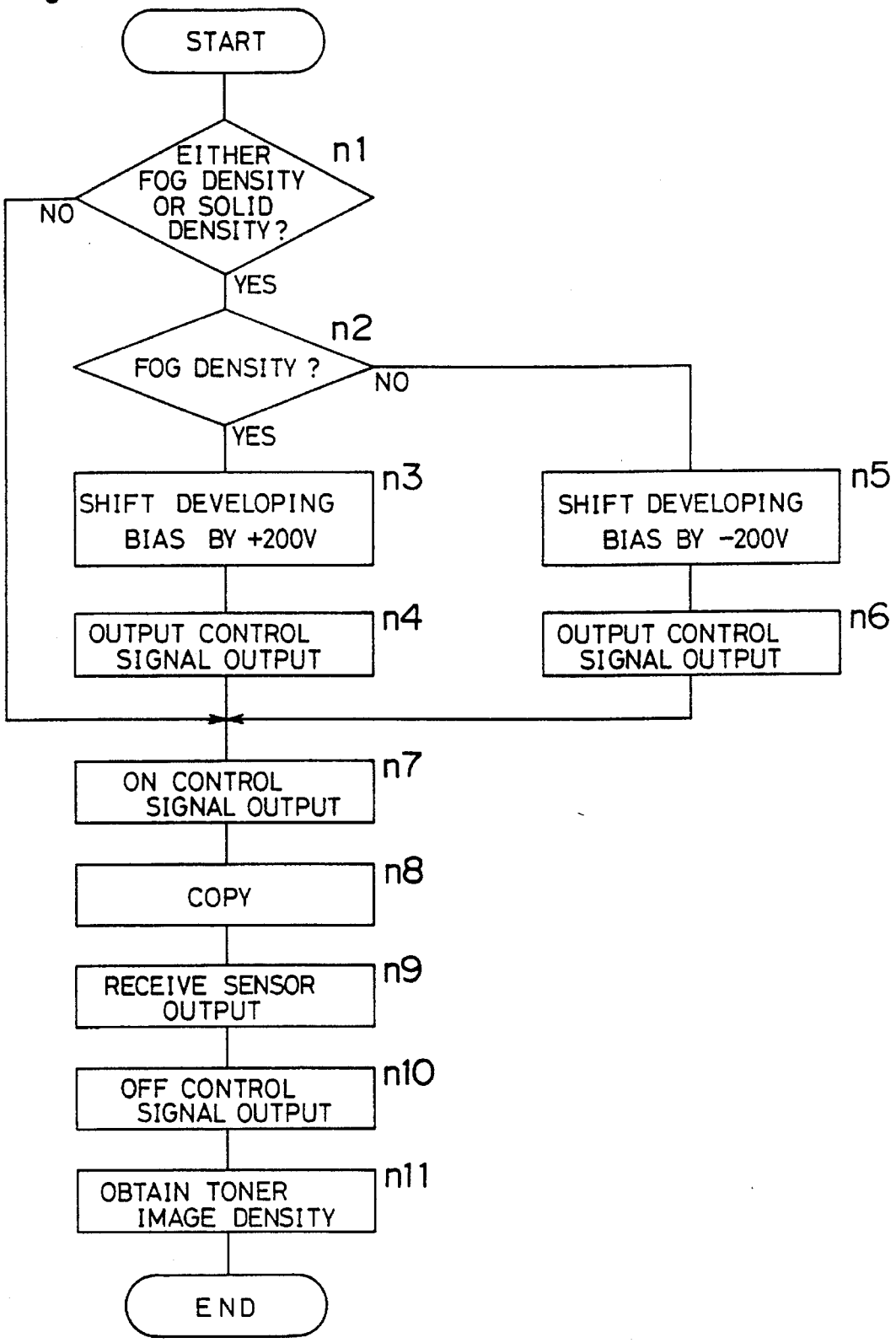
FIG. 5 is a flow chart illustrating a procedure for density adjustment.

FIG. 5 is a flow chart illustrating an operation of the control circuit 22 in adjusting a density. It is judged if the fog density or the solid density is adjusted at Step nl, and if it is an adjustment for neither of them, or an adjustment for a gray or medium density, the process proceeds to Step n7. A judgment at Step nl is conducted based upon an input from the parameter adjusting unit 35. The engineer conducting adjustments, in adjusting a density, first inputs a density value of a reference original in advance and thereafter manipulates the print key 38. At this time, the copy density set by using the density regulating key 39 is utilized as a standard value, for example. In response to manipulation of the print key 38, the judgment at Step nl is conducted. Then, if the input density value corresponds to neither the fog density nor the solid density, the process proceeds from Step nl to Step n7.

When the input density value corresponds to the fog density, the process proceeds from Step n1 to Step n2 and then Step n3. Then, data corresponding to a developing bias is shifted by a fixed value along the positive direction (e.g., a value corresponding to 200 V). The output control signal which causes the shifted developing bias to be output is applied from the line 25 to the developing bias circuit 21 (Step n4). A white reference original for adjusting the fog density is copied, the shifted developing bias being applied between the photoconductor drum 9 and the developing sleeve 12A (Step n7 and Step n8). At this time, the surface potential at the photoconductor drum 9 after exposure to light takes a value corresponding to the gray or medium density.

Figure 6:
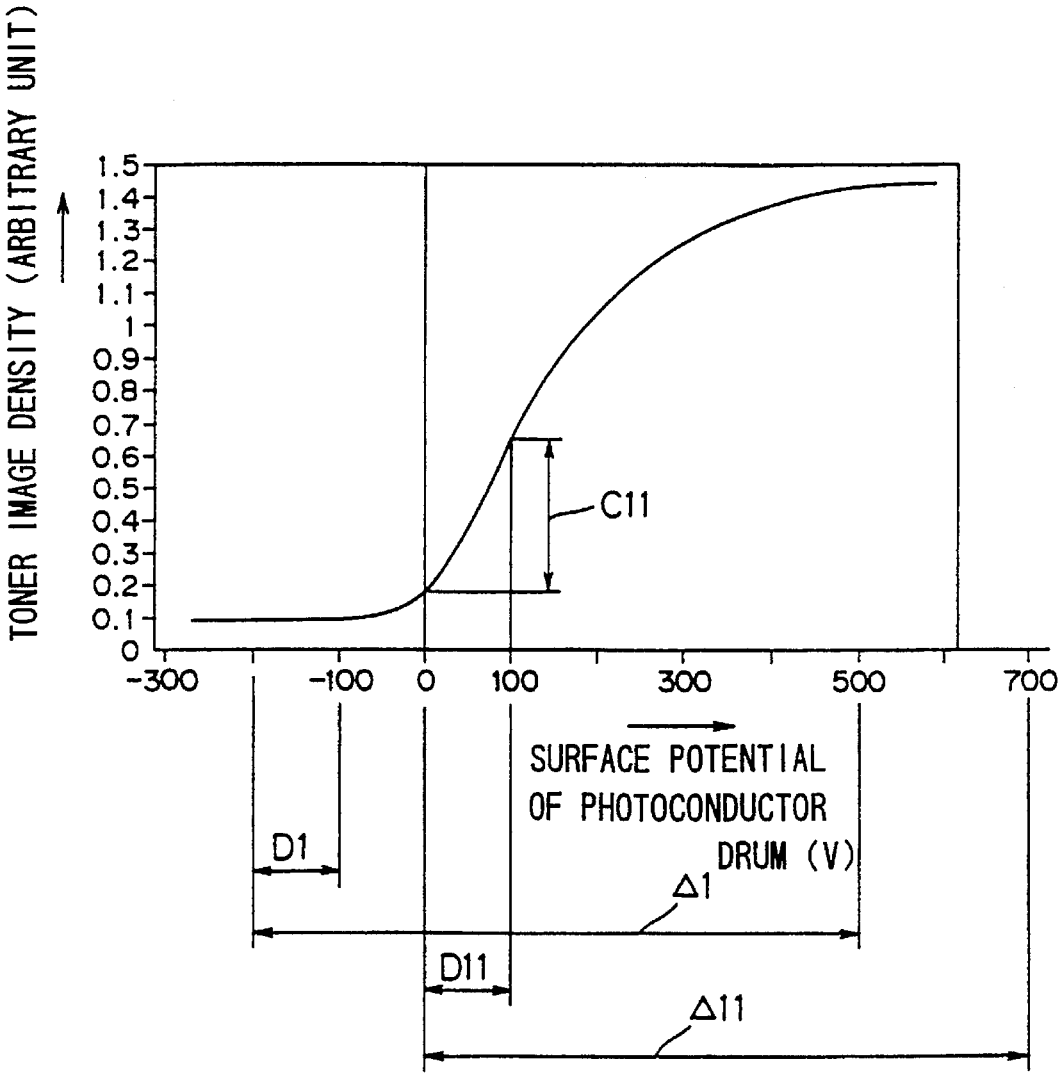
FIG. 6 is a diagram illustrating an operation in the event of adjusting a fog density.

With the developing bias determined upon an actual copying process (e.g., 0 V potential is applied to the photoconductor drum 9), the surface potential of the photoconductor drum 9 takes a value in a range of a section Δ1 in FIG. 6 responsive to an electrostatic latent image formed on the surface of the photoconductor drum 9. Hence, the surface potential of the photoconductor drum 9 in the event of copying the reference original of the fog density is of a value existing in the section D1. On the other hand, when the developing bias is shifted, the surface potential of the photoconductor drum 9 is of a value in a range of a section Δ11 in FIG. 6. As a result, the surface potential of the photoconductor drum 9 takes a value existing in a section D11 corresponding to the gray density in the event of copying the reference original of the fog density.

Thus, detection of the fog density is substituted by detection of the gray density by means of shifting the developing bias. Specifically, detecting the gray density by the reflection type photosensor 20, the fog density can be indirectly measured.

Upon the adjustment for the solid density, the developing bias is similarly shifted. For example, in adjusting the solid density, the process proceeds from Step n1 to Step n2 and then enters Step nS. The output control signal which shifts the developing bias by a specified value (e.g., 200 V) to the negative direction is applied to the developing bias circuit 21 (Step n5 and Step n6).

Figure 7:
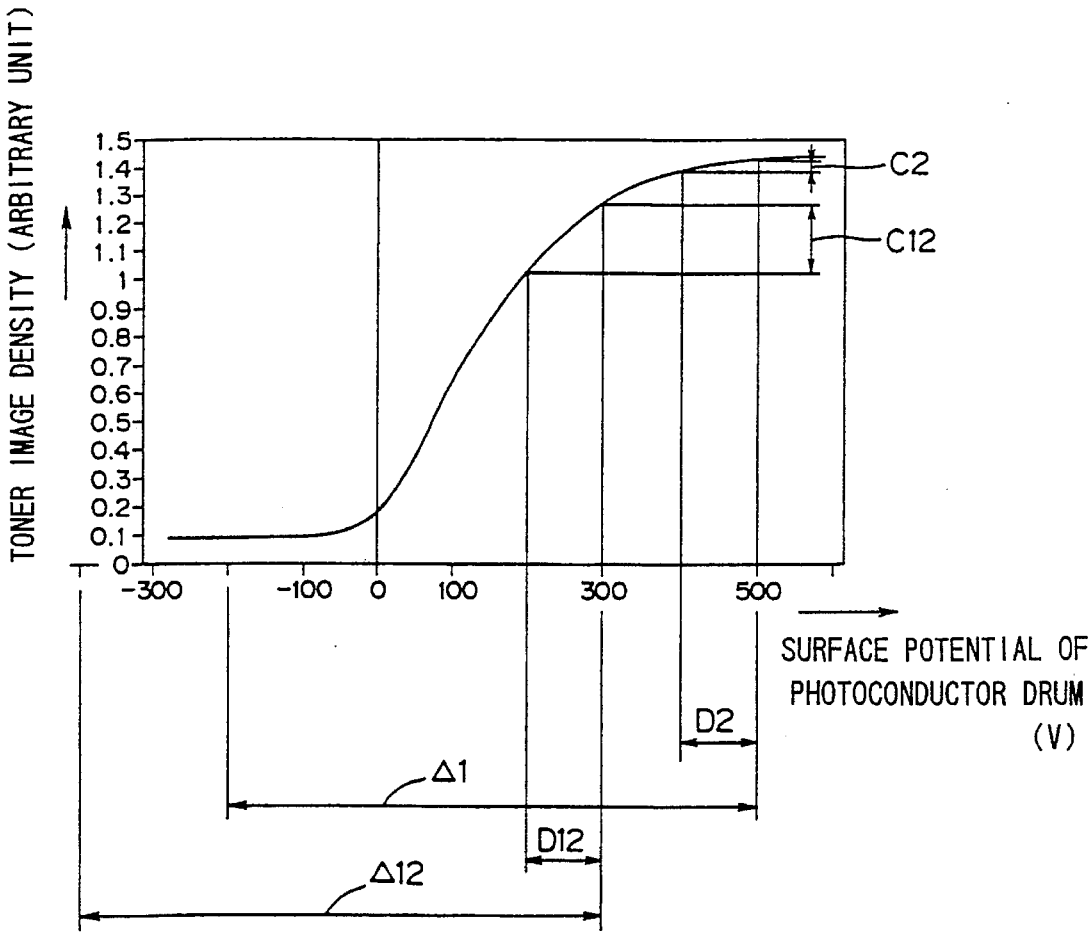
FIG. 7 is a diagram illustrating an operation in the event of adjusting a solid density.

This, as shown in FIG. 7, enables a range of values which the surface potential of the photoconductor drum 9 possibly takes to be shifted from the section Δ1 to a section Δ12. As a result, the density existing the solid density section D2 is also indirectly detected as a density existing in the section D12 covered by a gray density region.

At Step n7, an ON control signal for starting output of the developing bias is applied to the developing bias circuit 21, and at Step n8, copying is conducted. The copying is an operation where a reference original at any density level from the fog density to the solid density is copied on trial.

At Step n9, an output signal from the reflection type photosensor 20 is received by the control circuit 22 via the A/D converting circuit 23. Thus, a density of a toner image formed on the surface of the photoconductor drum 9 is detected. After that, at Step n10, an OFF control signal for interrupting output of the developing bias is applied to the developing bias circuit 21.

Based upon an output from the reflection type photosensor 20 received at Step n9, the control circuit 22 performs arithmetic operations to obtain a toner image density. When the copying is conducted by shifting the developing bias, the control circuit 22 estimates a density value of the toner image without shifting the developing bias, based upon the output from the reflection type photosensor 20 (Step n11). For this estimation, a table expressing correlations between the toner image densities in the sections D1 and D11 in FIG. 6 or a table expressing correlations between the toner image densities in the sections D2 and D12 in FIG. 7 is used. Such a table is stored in advance in the memory 22M in the control circuit 22.

The toner image density obtained by the arithmetic operation is displayed on the indicator 33. The engineer conducting density adjustments determines whether the displayed toner image density is identical with the density of the copied reference original; if not, he or she manipulates the parameter adjustment operating unit 35 to adjust at least one of various parameters related to the photoconductor drum 9, such as a degree of exposure of the photoconductor drum 9, a degree of electrostatic charge of the same, etc. Then, after copying the reference original again, adjustments are made until a time when density of the resulting toner image is identical with the density of the reference original, at which time the adjustments related to the density of the reference original are completed.

Such adjustments are performed for reference originals at various density levels from the fog density to the solid density, and eventually, a group of parameters according to which toner images of good density can be obtained for every reference original. Such group of parameters is stored in the memory 22M.

In this way, the parameters for the case where the copy density is set to a standard value by the density setting key 39 are stored in the memory 22M. Image forming conditions for any density setting value determinable by the density setting key 39 are defined by arithmetic operations based upon the parameters stored in the memory 22M. Adjustments similar to those conducted when the copy density is set to the standard value may be performed for all or part of the density setting values determinable by the density setting key 39.

In an actual copying process, the control circuit 22 controls the light source driving circuit 28, the high voltage unit 29 and the developing bias circuit 21 based upon the parameters stored in the memory 22M.

As previously mentioned, in this embodiment, when a fog density and a solid density are adjusted, a developing bias is shifted by a specified width to indirectly detect a toner image density in a region of a gray density where a sensitivity of a sensor is high. Thus, since the developing bias is shifted by a specified width, the detected density in the gray density region can be calculated into the fog density and the solid density based upon the width by which the developing bias is shifted.

While there arises almost no density difference in spite of the difference of surface potential at the photoconductor drum 9 in the section D1 in FIG. 6, for example, a large density difference C11 arises in the section D11. Similarly, although a density difference C2 is small compared with the difference of surface potential at the photoconductor drum 9 in the section D2 in FIG. 7, a density difference C12 in the section 12 is great. Essentially, the fog density and the solid density corresponding to the sections D1, D2 where less density difference is caused cannot be detected easily by a photosensor. However, in such an arrangement as in this embodiment that density detection in the sections D11, D12 in the gray density region is alternatively employed instead of density detection in the sections D1, D2, large density variations can be caused in the fog density and the solid density. Hence, detection of a toner image density can be conducted with a sufficient resolution.

Figure 8:
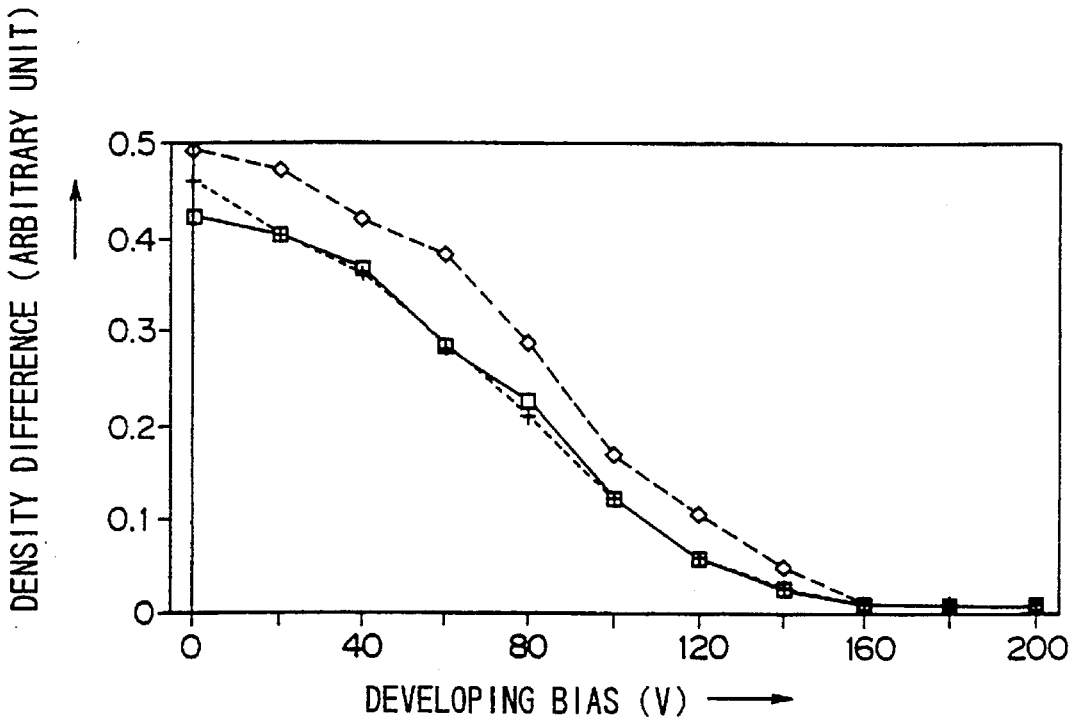
FIG. 8 is a diagram illustrating an expansion of a density difference caused by a shift of a developing bias.

FIG. 8 is a diagram illustrating an expansion of the density difference related to the quantity of shifting the developing bias. FIG. 8 represents the difference in toner image density when Munsell originals of density levels "8.5" and "9.5" corresponding to the solid density are respectively copied. An ordinary developing bias is 200 V; that is, –200 V is applied to the developing sleeve 12A while 0 V is applied to the photoconductor drum 9. As the developing bias is shifted to the negative direction, the density difference is expanded from about zero to 0.4 to 0.5. It should be noted that with the developing bias shifted by 200 V to the negative direction, the density difference is expanded 100 times or more.

Curves sectioned by symbols "□", "◇", and "+" in FIG. 8 respectively represent results of density measurement by a sensor installed in different positions along the elongated direction of the photoconductor drum 9.

In this way, using an existing arrangement for variable control of the developing bias, the reflection type photosensor 20 can well detect a density of a toner image in any density region; that is, the reflection type photosensor 20 can be used to detect the toner image density in any density region with high sensitivity. Thus, it is not necessary to vary an operative point of the reflection type photosensor 20 and its sensitivity, and therefore, there is no need to connect any special variable resistor to the sensor 20.

Further, the above mentioned arrangement where a resistance value of a variable resistor is varied to vary an operative point of a sensor or its sensitivity is restricted in variation of its output characteristic. For that reason, extreme densities like a fog density and a solid density cannot always be detected with high sensitivity. In the arrangement of the previously mentioned embodiment where the gray density region is utilized to indirectly detect the fog density and the solid density, a region where the reflection type photosensor 20 works at high sensitivity is utilized to detect a density with sufficient resolution. This enables the toner image density to be well detected for all the density region, and density adjustments through adjustments of parameters in connection with the photoconductor drum 9 can be performed well.

Figure 9:
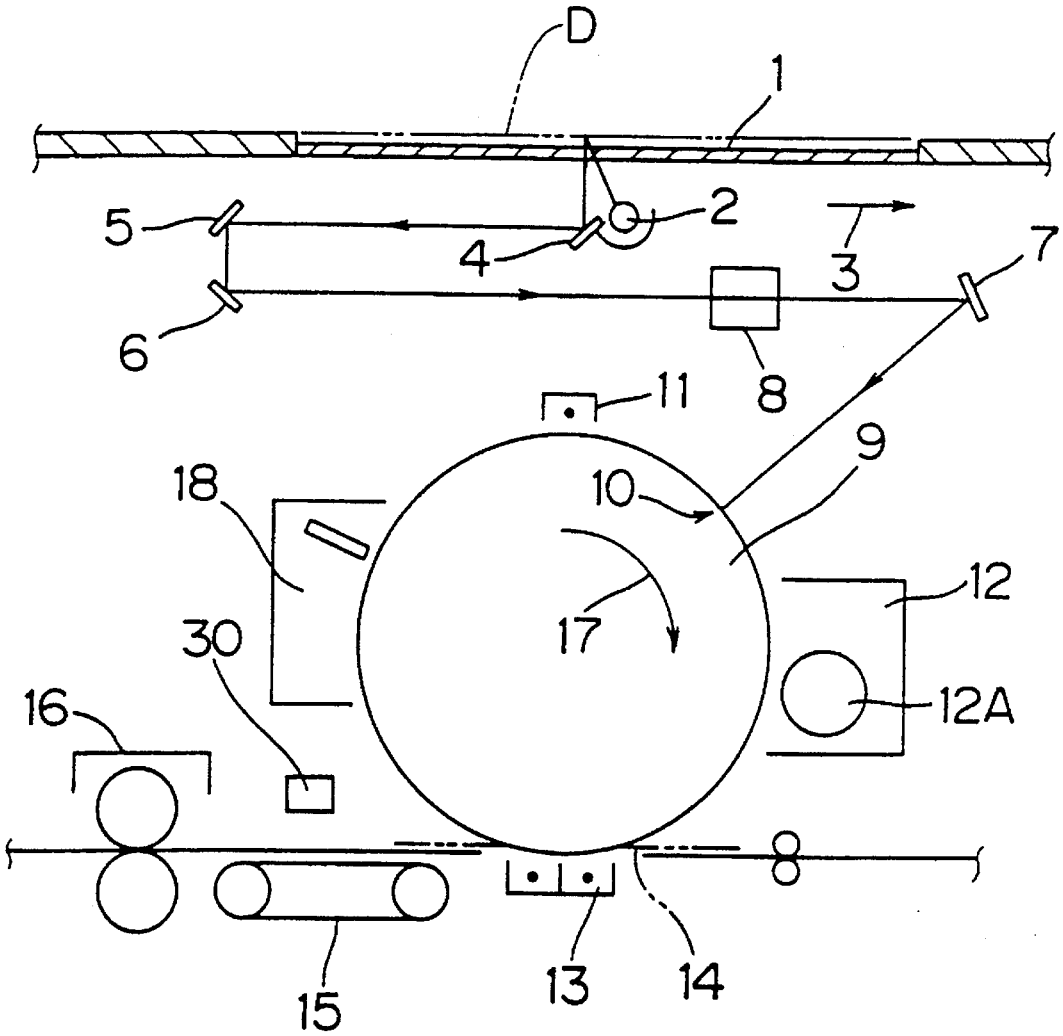
FIG. 9 is a schematic diagram depicting an internal structure of an electrostatic copying machine of a second embodiment according to the present invention.

FIG. 9 is a diagram illustrating a mechanical arrangement of a second preferred embodiment according to the present invention. In FIG. 9, like reference numerals in FIG. 1 denote corresponding parts. In this embodiment, a reflection type photosensor 30 for density detection is positioned opposed to a conveying path for a sheet after transfer of a toner image thereto; that is, the reflection type photosensor 30 is provided opposed to a conveying belt 15 for leading a sheet from a transferer 13 to a fuser 16.

In such an arrangement, a density of the toner image after transfer to a copy sheet 14 is detected by the reflection type photosensor 30. In this way, functions and effects similar to those described in the previous first preferred embodiment can be attained.

Figure 10:
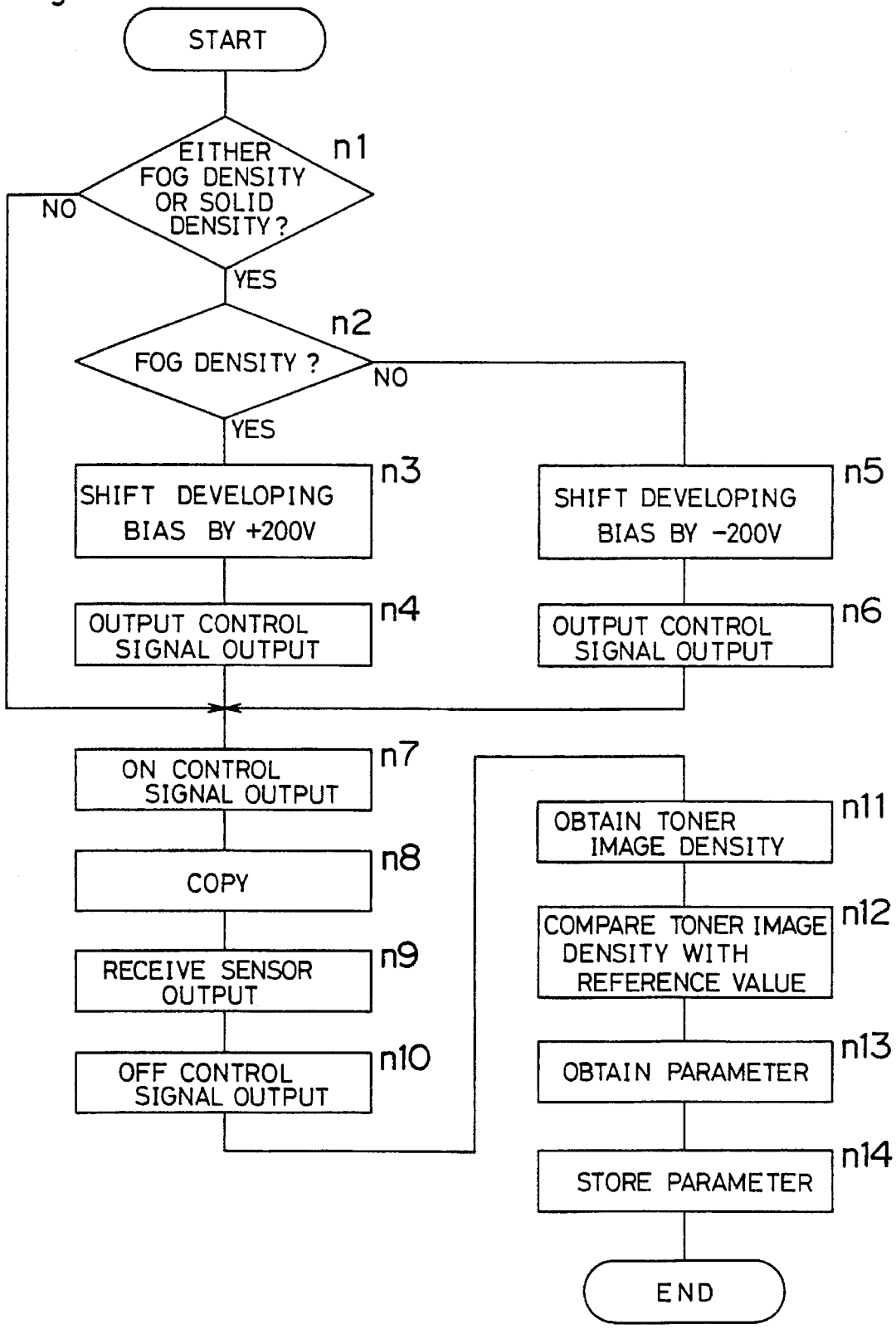
FIG. 10 is a flow chart illustrating a procedure in the event of adjusting a density in a third preferred embodiment according to the present invention.

FIG. 10 is a flow chart illustrating a third preferred embodiment according to the present invention. This embodiment will also be described with reference to FIGS. 1 and 3. FIG. 10 depicts an operation of a control circuit 22 in adjusting a density, where steps of operations similar to those illustrated in FIG. 5 are marked with like reference alphanumeric symbols.

In this embodiment, after obtaining a density of a toner image (Step n11), operations at Steps n12, n13 and n14 are conducted. More specifically, at Step n12, the toner image density obtained is compared with a reference density value which is predetermined corresponding to a density value of a reference original copied in advance. Several kinds of reference density values are stored in the memory 22M. Then, one of the reference density values corresponding to a density value input from a parameter adjustment operating unit 35 is read from the memory 22M. At Step n13, parameters according to which an adequate toner image density can be obtained are found based upon a comparison result. The parameters obtained are stored in the memory 22M in a control circuit 22 at Step n14.

Similar operations are performed to reference originals at several density levels from a fog density to a solid density. At this time at Step n13, when the parameters obtained for a certain density value still remain in the memory 22M, average values of the parameters obtained as the result of the comparison at step 12 and the parameters stored in advance are calculated. The average values are stored as new parameters in the memory 22M.

In this way, parameters in connection with the photoconductor drum 9 can be almost automatically adjusted in this embodiment. Adjustment procedures can be almost completely automated if the reference originals are supplied to the top of an original plate 1 by an automatic original feeder. In this case, density values of the reference originals on the original plate 1 may be detected by an original density sensing means not shown to operate the control circuit 22 based upon a detection result.

This embodiment can naturally be applicable to the arrangement of the previous second preferred embodiment shown in FIG. 9.

Figure 11:
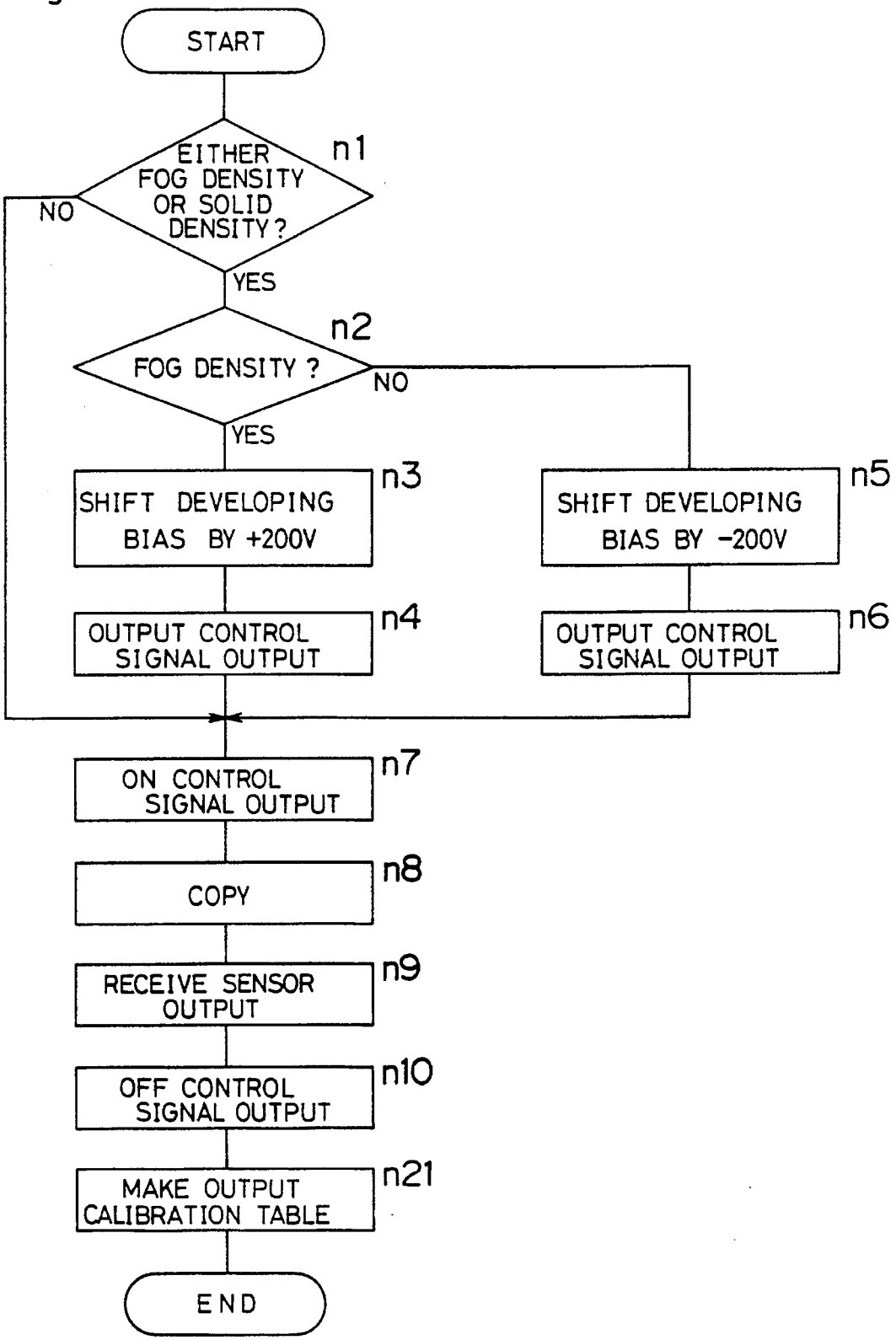
FIG. 11 is a flow chart illustrating an operation in the case where an output from a reflection type photosensor is calibrated in a fourth preferred embodiment according to the present invention.

FIG. 11 is a flow chart illustrating a fourth preferred embodiment according to the present invention. This embodiment will also be described with reference to FIGS. 1 and 3. In FIG. 11, like reference numerals denote corresponding steps of similar steps in FIG. 5.

In this embodiment, an output from a reflection type photosensor 20 is calibrated in a copying machine where parameters in connection with a photoconductor drum 9 have been adjusted. For example, an original of a reference density is copied on trial, and a toner image density value corresponding to the reference density is allotted to an output value from the reflection type photosensor 20 in the copying.

Specifically, a developing bias in accordance with a density of a reference original to be copied is applied between the photoconductor drum 9 and a developing drum 12A to copy the reference original in such a situation through operations at Step n1 through Step n8. An output from the reflection type photosensor 20 is received at Step n9, and after application of the developing bias is interrupted at Step n10, an output calibration table is made at Step n21; that is, data from an A/D converter 23 is correlated to a toner image density value corresponding to a density value of a copied reference original, and a correlation between them is stored as the output calibration table in a memory 22M. When the density value of the reference original corresponds to a value of a fog density or a solid density, output data from the A/D converter 23 is calculated into a value as it is before shifting a developing bias. The correlation between the calculated value and the toner image density value corresponding to the original sheet is stored in the output calibration table.

If identical procedures are performed to several reference originals at density levels from "0" to "10", a toner image density can be accurately detected based upon an output from the reflection type photosensor 20. When the output from the reflection type photosensor 20 is almost in proportion to the toner image density, a process to only one reference original allows an output from the reflection type photosensor 20 to be calibrated. This is because once a proportional constant is found, the output from the reflection type photosensor 20 can be calibrated by arithmetic operations.

With the above-mentioned adjustment operations, adverse effects which are exerted upon detection of a toner image density by variations in characteristic of reflection type photosensors mounted in copying machines can be suppressed.

Figure 12A:
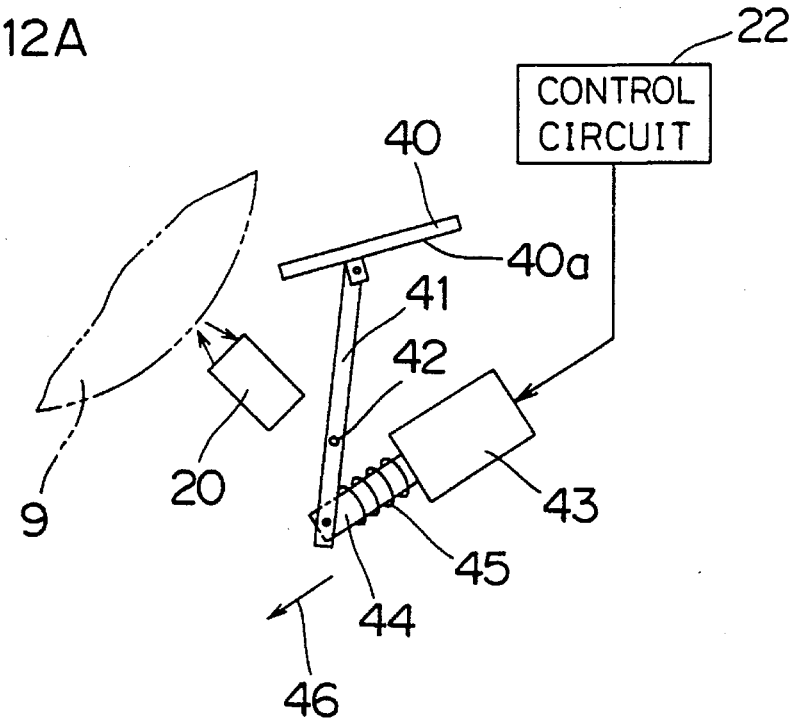
FIGS. 12A and 12B are diagrams showing an arrangement for calibrating an output from a reflection type photosensor in a fifth preferred embodiment according to the present invention.
Figure 12B:
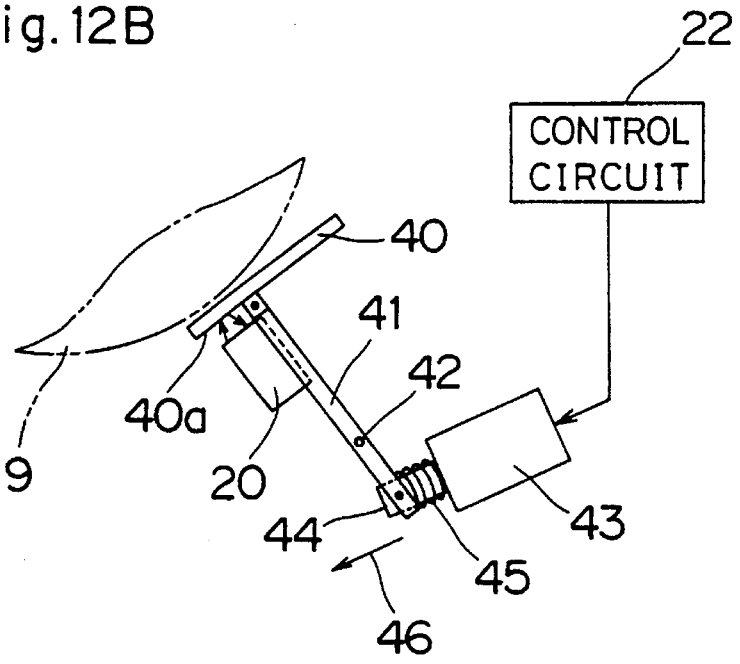
Figure 13:
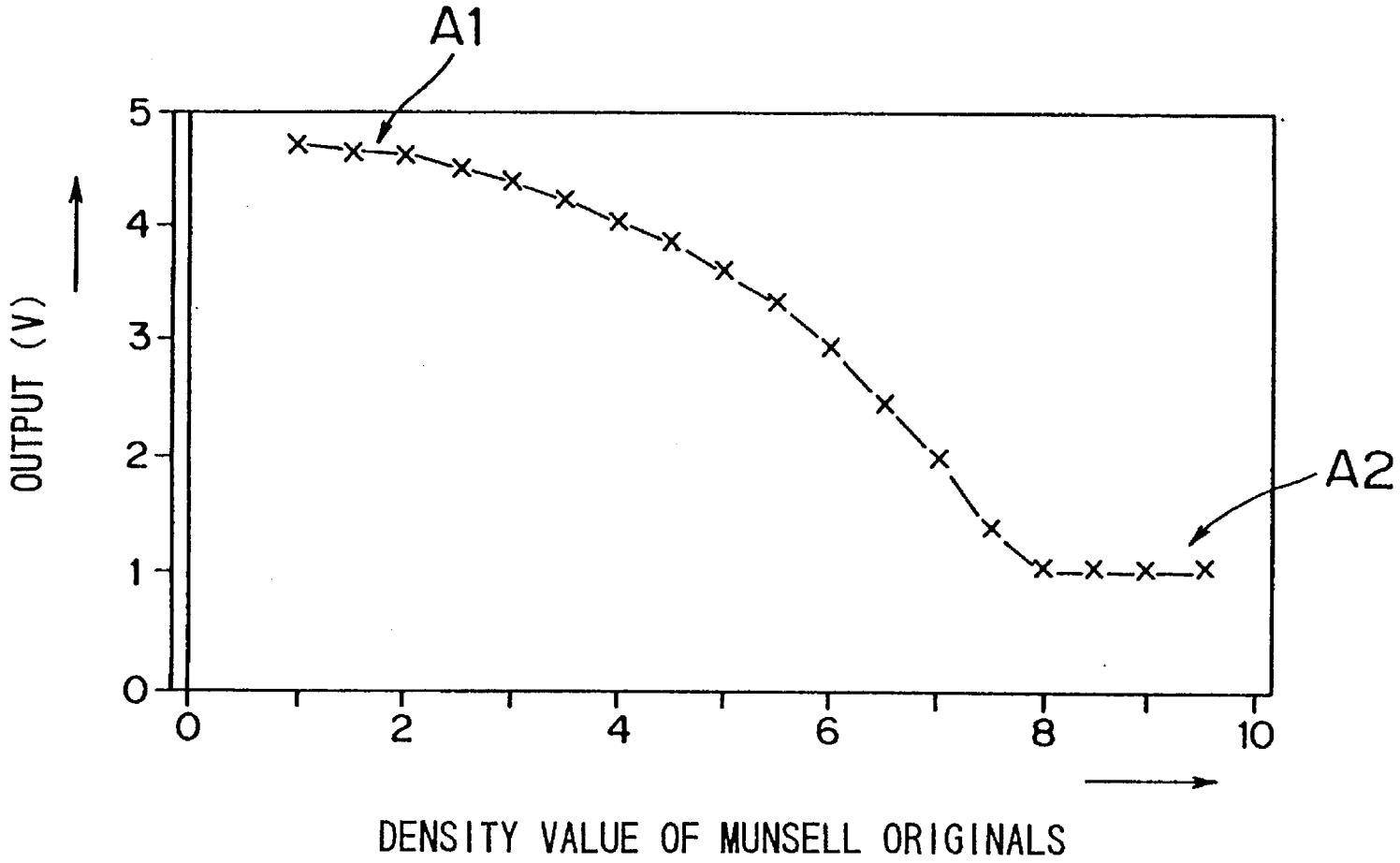
FIG. 13 is a diagram illustrating an output characteristic of the reflection type photosensor related to reference originals of various densities.
Figure 14:
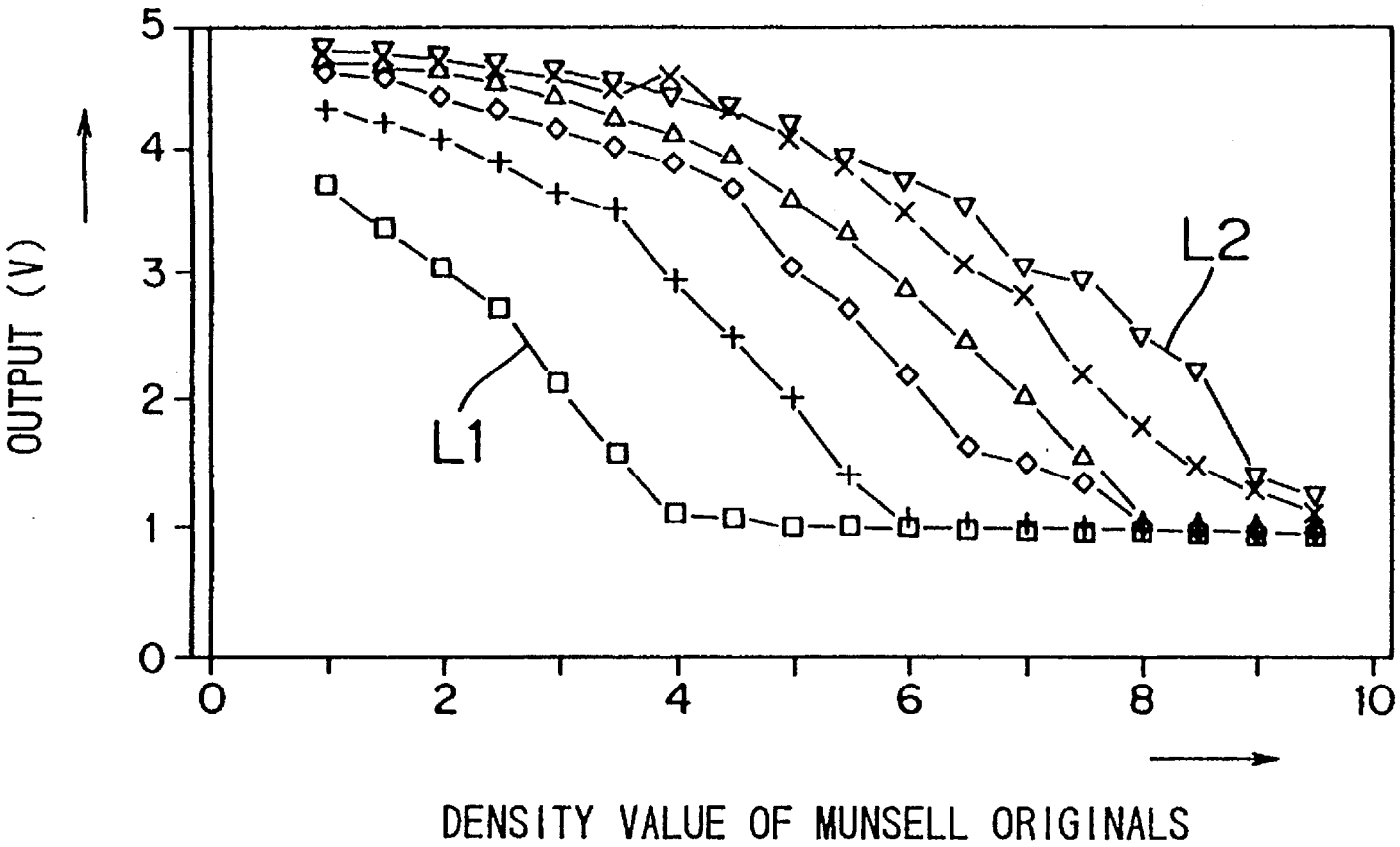
FIG. 14 is diagram illustrating an output a characteristic of the reflection type photosensor in the case where a variable resistance is connected to the photosensor and a resistance value of the variable resistance is varied.

FIGS. 12A and 12B are diagrams illustrating a fifth preferred embodiment according to the present invention. This embodiment will also be described with reference to FIGS. 1 and 3. In FIG. 12, like reference numerals denote corresponding parts shown in FIG. 1. This embodiment relates to calibration of an output from a reflection type photosensor 20. In the above fourth preferred embodiment, a reference original is copied, and a density of a toner image formed on a surface of a photoconductor drum 9 is detected by the reflection type photosensor 20 to form an output calibration table used for calibrating the output from the reflection type photosensor 20 based upon a detection result. In the fifth embodiment, however, an output calibration table is made without copying a reference original.

For example, in making the output calibration table, as shown in FIG. 12B, a reference original 40 having an image of a reference density is placed between the reflection type photosensor 20 and the photoconductor drum 9 with a surface 40*a* where an image is formed being opposed to the reflection type photosensor 20. Then, the output from the photosensor 20 is, after converted by an A/D converter 23 into digital data, received by a control circuit 22. The received data is correlated to a toner image density value corresponding to a density of the image on the reference original 40, and data representing a correlation is stored in the output calibration table.

The reference original 40 is supported by a supporting bar 41 which is rotatably attached to a shaft 42 fixed within a copying machine body. The reference original 40 is held by one end of the supporting bar 41, and an actuator 44 is fixed to the other end of supporting bar 41. The actuator 44 is driven by a solenoid 43, and it is also urged by a coil spring 45 toward a direction along an arrow 46. Thus, a state as illustrated in FIG. 12A is observed if the solenoid 43 is demagnetized while a state in FIG. 12B is observed if the solenoid 43 is magnetized. Thus, under control of the control circuit 22, the solenoid 43 is magnetized when the output calibration table is made.

The reference original 40 may be placed between the reflection type photosensor 20 and the photoconductor drum 9, held by a hand of an operator.

Although the preferred embodiments of the present invention have been described, it should not be limited to these embodiments. For example, while the reflection type photosensor 20 is positioned between the developer 12 and the transferor 13 in the above embodiments, the reflection type photosensor for detecting a toner image density may be placed in any position from the developer 12 to the cleaner 18 passing through the transferor 13; that is, once it is determined that transfer of a toner image is not conducted in adjusting a density, the density of the toner image on the photoconductor drum 9 can be detected in any position as mentioned above.

Although a cylindrical photoconductor is used for the photoconductor drum 9 in the above embodiments, the photoconductor does not have to be cylindrical, but it may be endless belt-shaped one; or otherwise, the present invention is applicable to a copying machine where belt-shaped sensitized paper wound up in a roll is continuously drawn to form a toner image thereon.

Although a toner image is formed on the surface of the photoconductor drum 9 in the above embodiments, the present invention may have an arrangement where an electrostatic latent image formed on photoconductor is transferred to a separate insulator, and the electrostatic latent image transferred on the insulator is developed into a toner image. In this case, a reflection type photosensor may be placed opposed to a surface of the insulator having the toner image.

Moreover, while an exemplary electrostatic copying machine has been described in the above embodiments, the present invention is applicable to an image forming apparatus in which an image is formed in accordance with a electrophotography process as in a laser beam printer.

Although the preferred embodiments according to the present invention have been described in detail, these are understood by way of example only for setting forth the technical subjects of the present invention, and the present invention should not be limited to these examples nor be taken in a narrow sense. The true spirit and scope of the present invention should be defined by the description of the appended claims.

What is claimed is:

1. An image forming apparatus, comprising:

a photoconductor having a surface on which an electrostatic latent image is formed corresponding to an intended image;

a developing device for developing an electrostatic latent image into a toner image;

developing bias control means for variably controlling a developing bias which corresponds to a potential difference between said surface of said photoconductor and said developing device;

a reflection type photosensor, provided opposed to a toner image carrier for carrying a toner image thereon, said reflection type photosensor for irradiating the toner image carrier with a specified quantity of light and detecting a quantity of light reflected therefrom;

means for detecting a fog density, a gray density or a solid density of the toner image based upon an output from said reflection type photosensor;

means for inputting an adjustment signal representative of an image density to be adjusted based on an output from said means for detecting; and bias shift means for controlling said developing bias control means and shifting the developing bias by a specified width when adjusting to one of a fog density or a solid density in response to said adjustment signal from said means for inputting an adjustment signal, thereby forming a gray density toner image.

2. An image forming apparatus according to claim 1, further comprising:

condition input means for inputting image forming conditions when adjusting an image density, wherein the image forming conditions affect a density of a toner image to be formed on said image carrier;

wherein an adjustment of an image density is carried out by inputting image forming conditions from said condition input means, after forming a toner image corresponding to a reference original image of a specified density level and detecting a density of the toner image, wherein the adjustment is made based on a comparison of the detected density and a specified reference value corresponding to said reference original image.

3. An image forming apparatus according to claim 2, wherein said bias shift means controls said developing bias control means, in response to an adjustment signal representing that a fog density is present, to increase said developing bias by a first specified width so as to form a gray density toner image for a reference original image of a fog density.

4. An image forming apparatus according to claim 2, wherein said bias shift means controls said developing bias control means, in response to an adjustment signal representing that a solid density is present, to decrease said developing bias by a first specified width so as to form a gray density toner image for a reference original image of a solid density.

5. An image forming apparatus according to claim 1, wherein said density detecting means includes means for obtaining a density of a toner image which should have been formed if the developing bias had not been shifted, based upon an output from said reflection type photosensor and said specified width of the developing bias shift, when a toner image is formed with the developing bias being shifted by said specified width.

6. An image forming apparatus according to claim 1, further comprising:

means for comparing the detected density of the toner image with a specified reference density; and correcting means for correcting image forming conditions based upon a result of a comparison by said comparing means.

7. An image forming apparatus according to claim 1, wherein said toner image carrier is said photoconductor.

8. An image forming apparatus according to claim 1, wherein said toner image carrier is a recording sheet to which a toner image is transferred.

9. A method for detecting a density of a toner image carried by a toner image carrier with a reflection type photosensor which irradiates the toner image carrier with a specified quantity of light and detects a quantity of light reflected therefrom, said method being applicable to an image forming apparatus for developing an electrostatic latent image formed on a photoconductor into a toner image by a developing device including means for applying a specified potential difference as a developing bias between the photoconductor and the developing device, said method comprising the steps of:

judging which toner density is to be detected from the group of a fog density, a gray density or a solid density;

shifting the developing bias by a first specified width under a condition where a density of a fog density toner image is judged, such that a gray density toner image is formed, or alternatively, shifting the developing bias by a second specified width under a condition where a density of a solid density toner image is judged, such that a gray density toner image is formed; and detecting a toner image density on said toner image carrier based upon an output from said reflection type photosensor.

10. A method according to claim 9, further comprising the step of:

obtaining a density of a toner image which should have been formed if the developing bias had not been shifted, based upon the output from the reflection type photosensor and said first specified width, under a condition where a density of a fog density toner image is judged, or alternatively, obtaining a density of a toner image which should have been formed if the developing bias had not been shifted, based upon the output from the reflection type photosensor and said second specified width, under a condition where a density of a solid density toner image is judged.

11. An image forming apparatus, comprising:

a photoconductor having a surface on which an electrostatic latent image is formed corresponding to an intended image;

a developing device for developing an electrostatic latent image into a toner image;

developing bias control means for variably controlling a developing bias which corresponds to a potential difference between said surface of said photoconductor and said developing device;

a reflection type photosensor provided opposed to a toner image carrier for carrying a toner image thereon, said reflection type photosensor for irradiating the toner image carrier with a specified quantity of light and detecting a quantity of light reflected therefrom;

means for comparing a density detected based upon an output from said reflection type photosensor with a reference density when an image of said reference density is put opposed to said reflection type photosensor, wherein said image of said reference density is a toner image carried by the toner image carrier, and said image of said reference density includes an image of a fog density, an image of a gray density or an image of a solid density;

output calibrating means for calibrating the output of said reflection type photosensor based upon a result of a comparison by said comparing means;

bias shift means for controlling said developing bias control means and, when calibrating the output of said reflection type photosensor corresponding to one of a fog density or a solid density, shifting the developing bias by a specified width, thereby forming a gray density reference toner image; and means for obtaining an output of said photosensor which should have been output if the developing bias had not been shifted, based upon said specified width for shifting the developing bias, when a toner reference image is formed with the developing bias being shifted by said specified width;

wherein said means for comparing compares an output obtained by said means for obtaining an output, when calibrating the output of the photosensor corresponding to one of a fog density or a solid density, with said reference density.

* * * * *